US005400006A

United States Patent [19]

Cardozo

[11] Patent Number: 5,400,006

[45] Date of Patent: Mar. 21, 1995

[54] CURRENT TRANSFORMER WITH PLURAL PART CORE

[75] Inventor: Rubén S. Cardozo, Massy, France

[73] Assignee: Schlumberger Industries, Montrouge, France

[21] Appl. No.: 51,717

[22] Filed: Apr. 23, 1993

[51] Int. Cl.[6] ..... H01F 17/06; H01F 40/06

[52] U.S. Cl. ..... 336/175; 336/184; 336/210; 336/212; 336/233

[58] Field of Search ..... 336/174, 175, 176, 184, 336/233, 212, 210, 234, 83, 173

[56] References Cited

U.S. PATENT DOCUMENTS

| | | | |
|---|---|---|---|
| 1,415,505 | 5/1922 | Angus | 336/174 |
| 2,148,641 | 2/1939 | Reich | 336/176 |
| 2,175,934 | 10/1939 | Wentz | 336/176 |
| 3,258,657 | 6/1966 | Peuron et al. | 336/184 |
| 3,525,964 | 8/1970 | Stevenson | 336/212 |
| 4,471,271 | 9/1984 | Wendt | 336/212 |
| 4,800,356 | 1/1989 | Ellis | 336/184 |
| 4,864,486 | 9/1989 | Spreen | 336/175 |

FOREIGN PATENT DOCUMENTS

| | | | |
|---|---|---|---|
| 2800750 | 7/1979 | Germany | 336/212 |

OTHER PUBLICATIONS

Current Transformers, "Influence of Leakage Flux Under Various Conditions," Forrest, Electrical Review, Jul. 9, 1948, pp. 51–54.

*Primary Examiner*—Thomas J. Kozma
*Attorney, Agent, or Firm*—Sanford J. Asman

[57] ABSTRACT

A current transformer comprising a primary conductor means 20, secondary conductor means in the form of a first and second coil 21, 22 connected to ensure common-mode rejection of emf induced by external disturbing magnetic fields, and magnetic coupling means defined by first and second magnetic plates 23, 24 and first and second ferrite elements 25, 26 arranged within the first and second coils 21, 22, the elements 25, 26 contacting and physically separating the first and second plates 23, 24, thereby defining a closed magnetic circuit with the plates.

6 Claims, 3 Drawing Sheets

CURRENT TRANSFORMER WITH PLURAL PART CORE

BACKGROUND OF THE INVENTION

The present invention relates to a current transformer in which the current in a primary conductor induces a current in a second conductor.

Conventional AC current transformers fall into two categories; magnetic core current transformers such as the commonly used iron-core toroidal type, in which the primary conductor passes through the centre of the toroid so as to induce via the magnetic core a current in the secondary conductor coiled around the toroid, and air coupled current transformers in which a central coil defining the secondary coil is wound onto a non-magnetic material and the flux generated by a primary conductor is coupled to the secondary (at least in part) via an "air gap". A typical design for such transformers is shown in U.S. Pat. No. 4,473,810 (Souques) in which the secondary coil lies within the loop of a U shaped primary conductor, the whole assembly being surrounded by a shielding in the form of a box of ferromagnetic material. The shielding also serves as a path for the flux generated by the primary conductor.

Iron core transformers suffer from the disadvantage that the presence of DC components in the primary conductor cause saturation of the magnetic core and render the transformer insensitive to AC signals. Air coupled current transformers are immune to such saturation but suffer from the disadvantage that they are susceptible to the effects of external magnetic fields and normally require a magnetic shield made of a suitable nickel-iron alloy, such as mumetal, surrounding the sensor. Air coupled current transformers futher suffer from the disadvantage that they are relatively insensitive to low currents in view of the lower permeability of air as compared to a ferromagnetic material. Increasing the sensitivity and scale factor is conventionally achieved by increasing the number of turns in the coils, which leads to problems where a compact design of sensor is required.

A modified air coupled current transformer using a ferromagnetic element within the centre of the secondary coil is disclosed in DE 0 481 104. The magnetic circuit through which flux flows is defined by the ferromagnetic element, a ferromagnetic shield and the air gap between the element and shield. As with conventional air coupled current transformers, the position of the element and core within the sensor and, in particular, in relation to the surrounding shield, is critical in determining the scale factor or relative magnitude of the primary current to the secondary current. This sensitivity to the positioning of the coil is a further disadvantage of air coupled current transformers as it can be difficult to ensure regularity of performance in a batch of produced transformers.

BRIEF SUMMARY OF THE INVENTION

According to the present invention the current transformer comprises a primary conductor means, secondary conductor means in the form of a first and second coil arranged each side of the first conductor means and connected to ensure addition of emf induced by the first conductor means and to facilitate common mode rejection of emf induced by external magnetic fields, and magnetic coupling means in the form of a first and second ferromagnetic plates arranged above and below the first and second conductor means together with first and second ferrite elements arranged within the first and second coils, the first and second ferrite elements physically separating the first and second plates and defining a closed magnetic circuit with said plates.

By defining a closed magnetic circuit, i.e. with no air gap, the positioning of the coils within the sensor and between the surrounding plates becomes less critical as the majority of the flux generated by the primary conductor will be induced within this closed circuit.

The use of ferrite elements further increases the scale factor of the sensor and provides a sensor capable of detectiong lower ranges of currents as compared to air coupled transformers. Furthermore, unlike conventional iron-core sensors the use of a ferrite material ensures a relatively good resistance to saturation from DC components. Ferrites similarly have a relatively low coefficient of thermal expansion, and their-use to separate the two ferromagnetic plates ensures that the distance between these plates, and hence the overall scale factor of the sensor, will remain constant with temperature.

Typically, the ferrite elements can be chosen to have a permeability of approximately 2,500 to 4,000 to ensure a scale factor suitable for a low current application whilst being resistant to DC saturation. However, the permeability can be chosen to be considerably less than this, for example 10, where resistance to DC satururation is more important.

By the combination of the coils connected to facilitate comode-mode rejection and the use of a closed magnetic circuit comprising two ferromagnetic plates and two ferrite elements, the present invention provides a current transformer which does not require complete magnetic shielding and which is sensitive to low currents whilst being resistant to saturation and operable with the same characteristics over a range of temperatures.

The ferromagnetic plates can be made out of any suitable ferromagnetic material, such as mumetal. In one embodiment the ferromagnetic plates may be also made out of a ferrite material.

In this embodiment, the ferrite elements may be integral with the plates, for example, by forming each plate with two protuberances which extend into the first and second coils and contact protuberances on the other plate so as to close the magnetic circuit.

Preferably, the current transformer is easily disassemblable to allow the removal and replacement of the ferrite elements, for example, by ferrite elements of different characteristics or by ceramic elements. Replacement of the ferrite elements by ceramic ones converts the sensor into a standard air coupled transformer. Although this somewhat removes the advantages associated with having a closed magnetic circuit, the use of common-mode coupled coils together with ferromagnetic plates still provides a good rejection of external disturbing magnetic fields and such a sensor could be used, for example, where the ability to resist DC saturation was more important than the ability to detect lower currents. This embodiment of the invention thus allows one design of the transformer to be easily converted into another. In one embodiment, the sensor assembly may be held together by bolts passing through holes formed in the ferromagnetic plates and ferrite cores. In view of the brittle nature of ferrite materials, this arrangement is perhaps more suitable where the ferromagnetic plates are formed if mumetal. Other arrangements are easily envisageable which do not require holes in the plates.

As discussed, in conventional devices the scale factor and sensitivity are varied by adjusting the number of turns of the coils, which normally leads to the redesigning of the sensor structure to accomodate such variations. In contrast, the embodiment discussed above enables a universal design and size of sensor to be used in a number of applications by merely exchanging the ferrite elements for others.

The primary conductor means can be a single conductor extending through the sensor. However, in some metering applications it can be useful to measure the sum or difference of two or more currents. In such a case, the primary conductor means may comprise two or more parallel conductors. The emf induced in the secondary coils and the output thereof will be directly proportional to the sum or difference of the currents in the primary conductors, depending on the sense of the currents in the primary conductors.

There will now be described, by way of example only, a preferred embodiment and best mode of the present invention with reference to the accompanying figures. As will be realised, the invention is capable of other and different embodiments and the figures and description are to be regarded as illustrative in nature and not as restrictive.

BRIEF DESCRIPTION OF DRAWINGS

Referring to FIG. 1, a conventional air coupled current transformer is shown comprising a primary conductor 10, a secondary conductor in the form of a coil 11 and a box-shaped shield 12 made from a suitable ferromagnetic material 12 such as mumetal. As discussed above, this form of sensor suffers from the disadvantage that, in order to ensure good immunity to external magnetic fields a relatively large amount of shielding material must be used to make the shield 12. Furthermore, the conventional construction of the box-shaped shield 12 can be relatively time-consuming and expensive in view of the forming and/or shaping of the mumetal material required to produce this box. Also, electrostatic shielding in the form of a Faraday cage (not shown) may be required within the sensor between the primary 10 and secondary 11 to eliminate electrostatic signals generated.

Referring to FIG. 2, there is shown a current transformer according to an embodiment of the present invention comprising a primary conductor 20, a secondary conductor means in the form of two coils 21, 22 arranged symetrically around the primary conductor, two ferro-magnetic plates 23, 24, two ferrite elements 25, 26 and two bolts 27, 28 and associated nuts 29, 30. In assembling the transformer, the ferrite elements 25, 26 are arranged within the coils and contact and separate the ferromagnetic plates 23, 24 thereby forming a closed magnet circuit, the assembly being held together by the nut and bolts 27 to 30 which pass through holes formed in the plates and ferrite elements. In order to ensure good immunity to external disturbances two of the output terminals 31 to 34 of the coils 21, 22 are connected together and the total emf generated in the coils is taken across the other two terminals, the appropriate terminals being chosen according to the sense of the winding of the coils to ensure common-mode rejection of emf generated by external disturbing magnetic fields and the summation of emf generated by the magnetic field arising from the primary conductor 20.

Figure 1:
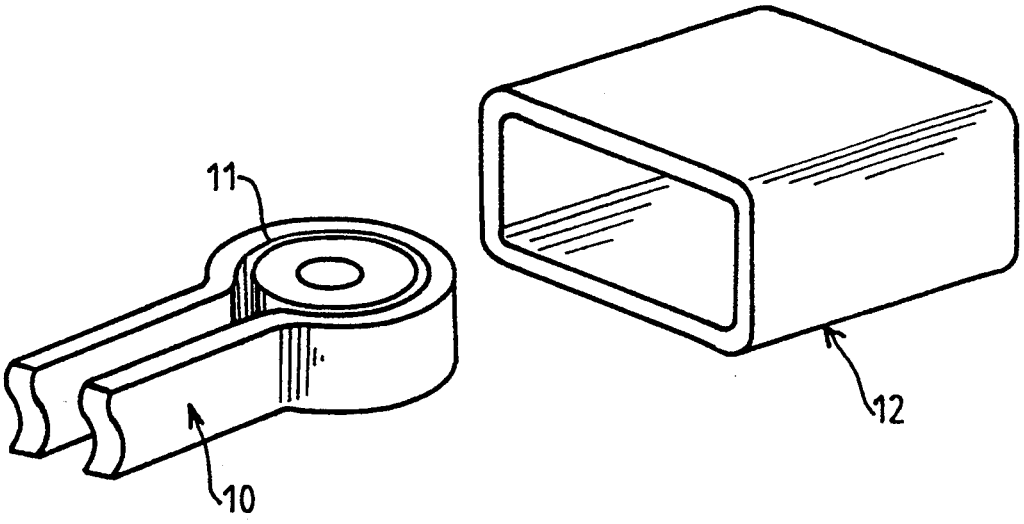
FIG. 1 is a perspective view of a prior art air coupled current transformer with surrounding magnetic shield.
Figure 2:
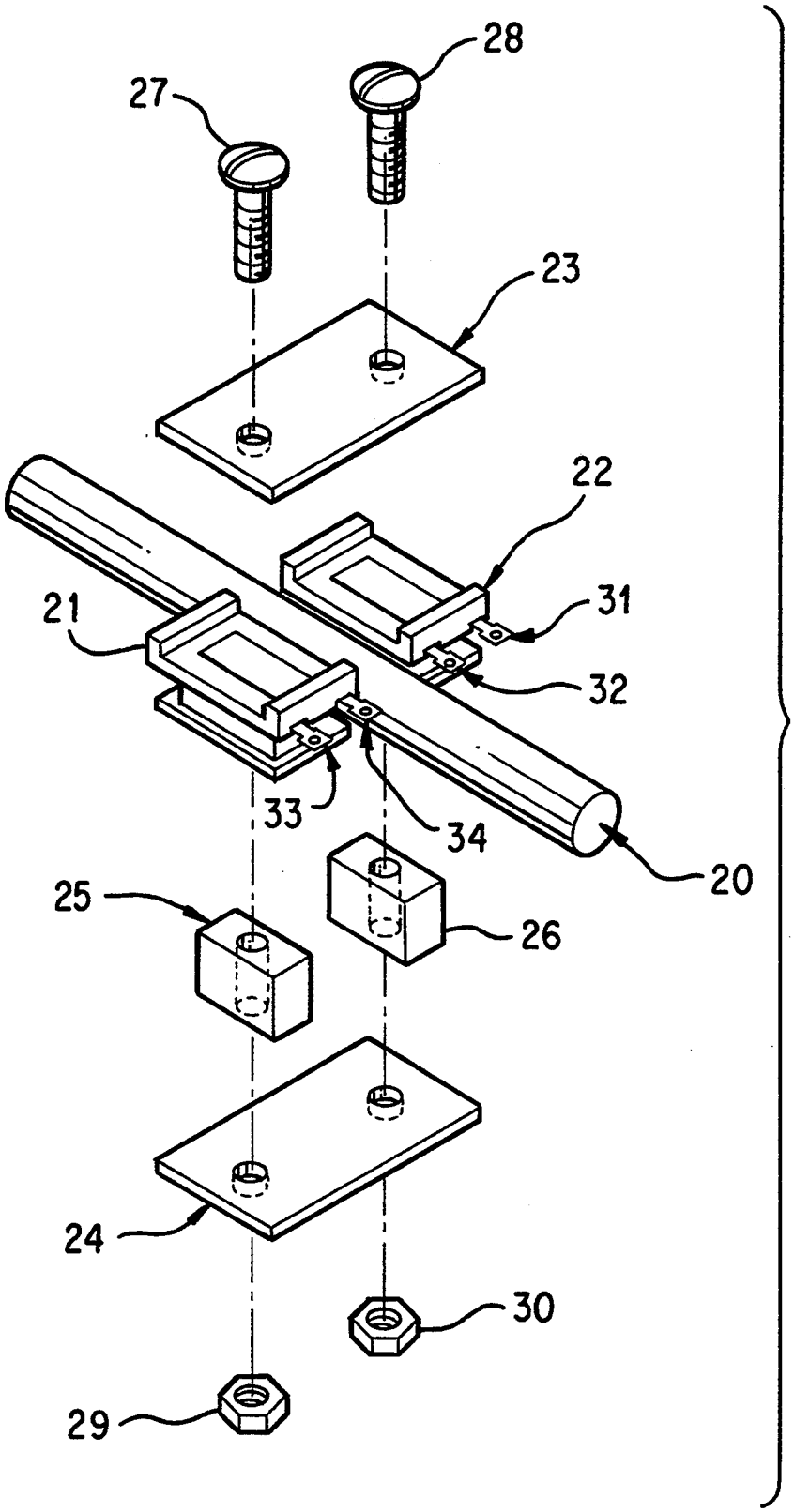
FIG. 2 is an exploded view of a current transformer according to an embodiment of the invention.
Figure 3:
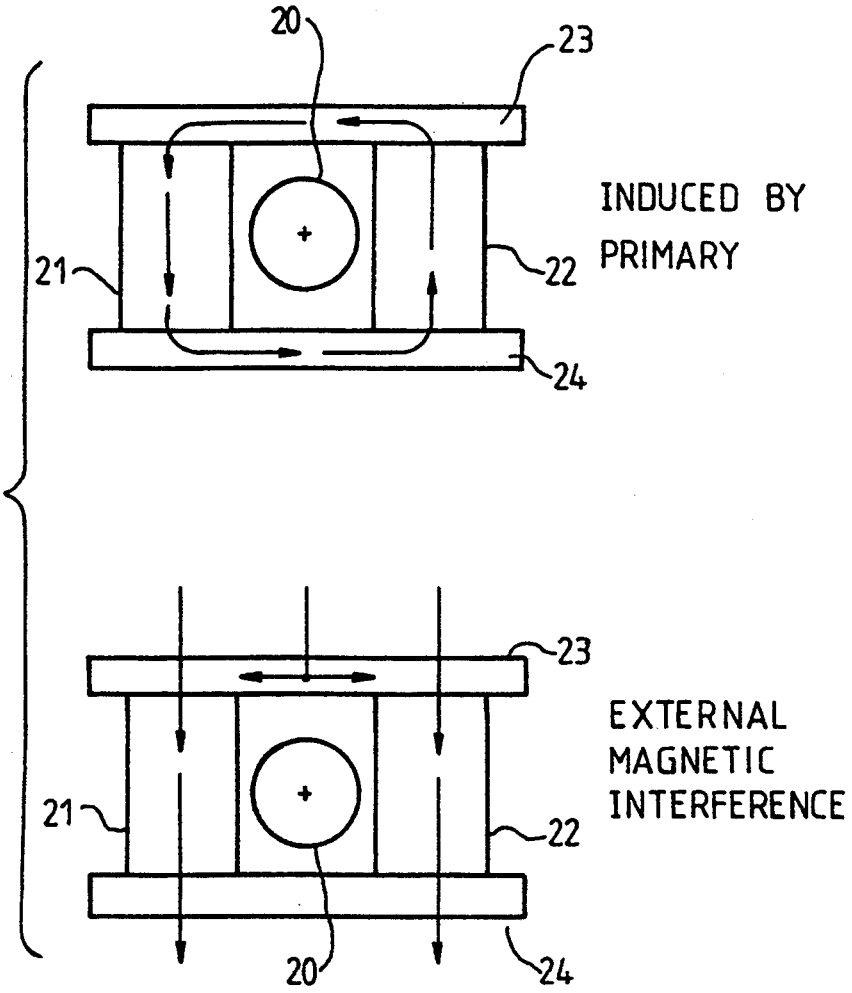
FIG. 3 illustrates the relative effects of magnetic flux induced by current carried by the primary conductor of the sensor and external disturbing magnetic fields in relation to the coupled coils of the sensor.

The magnetic fields due to current carried by the primary 20 and a likely external disturbing magnetic source are shown in FIG. 3. As will be appreciated, the relative sense of the magnetic field to each coil determines the sense of the emf generated in each coil and the windings of the coils are connected such that emfs induced in each coil by the primary conductor 20 are additive and the emfs induced by external fields are subtractive. Because the coils are so arranged around the axis of the primary conductor, the secondary circuit will only be sensitive to the flux along one of its three axes. The use of the common-mode connected coils also enables the rejection of electrostatic signals which are capacitively coupled between primary and secondary, thereby avoiding the need for any electrostatic shield between the two.

In the present embodiment, the primary conductor is shown as a single current carrying conductor. However, in certain embodiments where it is desired to measure the total sum or difference of two currents, a dual primary arrangement can be used in which the single conductor is replaced by two primary conductors are placed in parallel between the two coils. Depending on the relative sense of the currents in these conductors, and thus the relative sense of the magnetic fields induced (clockwise or anticlockwise), the emfs induced in the secondary will add or subtract to produce a value directly proportional to the sum or difference of the two primary currents. Other embodiments can be envisaged where more than two primary conductors are arranged in the window of the transformater, the emf produced being directly proportional to the algebraic sum of currents in the primary conductors.

In order to reduce the flux gradient seen by the secondary coils, the ferromagnetic plates 23, 24 are provided so as to cover the secondary coils from both sides. Since these plates are magnetic conductors they tend to homogenize or reduce the slope of the flux gradient in the space between them. One embodiment of the invention uses 0.062" thick rectangular ferromagnetic plates.

The presence of the plates thus confers immunity of the detrimental effects of ferromagnetic material in the vicinity of the transformer. In an air-coupled current transformer, in which the flux, which couples primary to secondary, flows entirely through the air, there exists a sensitivity to the presence of ferromagnetic material nearby. Since the coupling flux is not spatially confined, as it would be in a iron-core transformer, nearby magnetic material can alter the characteristics of the flux coupling path. Thus, the coefficient of coupling can be altered, and with it, the transformer scale factor. With the introduction of the two rectangular magnetic plates 23, 24, which become part of the magnetic coupling circuit with the ferrite elements 25, 26, the flux is confined to a small region. Magnetic material in the vicinity has no effect on the coefficient of coupling.

For fabrication of the plates, a ferromagnetic material, preferably comprising an alloy having 80% nickel, is used. The remaining 20% of the nickel alloy in the preferred embodiment comprises approximately 17% iron and 3% molybdenum, although some variation in the 20% portion of the alloy is tolerable. However, since the plates are much smaller than the shield of a conventional sensor, far less material is needed. Futhermore, unlike the shield which requires shaping, fabrication of the plates 25, 24, consists of a single stamping operation followed by an optional hydrogen anneal, which optimizes the magentic properties of the material. Therefore, the cost of the transformer according to the invention is significantly less than the cost of the prior art devices. The use of flat plates also means that, in an alternative embodiment these may be made of a ferrite material. This can give rise to savings in fabrication.

According to the preferred embodiment of the invention, the magnetic flux, which passes through the secondary coils, circulates around the magnetic path comprising the two plates 23 and 24, and the two ferrite elements 25 and 26 arranged within the secondary coils 21 and 22. The scale factor of the air-coupled transformer, which relates the input current to the output voltage, depends on the characteristics of the ferrite cores, the plates and the spacing of the plates.

In particular, the permeability of the ferrite material for the elements 25, 26 can be chosen depending on the scale factor required according to the particular application of the sensor. In a typical low-current embodiment, ferrite material of a permeability of initially 2,500 to a maximum 4,000 may be used. In comparison, the permeability of the mumetal plates within the magnetic circuit will be around 50,000. Ferrite materials have the advantage of having a relatively low coefficient of thermal expansion. Thus, over most normal temperatures ranges (and despite any heating due to primary currents) the spacing between the plates 23, 24 will remain fixed and the sensor will have a constant behaviour.

The exact scale factor of the sensor and the relative immunity to the effects of DC saturation can be determined through the choice of ferrite material. In the present embodiment, the simple construction of the sensor means that it may be unbolted to allow replacement of the ferrite elements 25, 26 by ferrite elements of different permeability, or even by ceramic elements, to thereby convert the sensor to be sensitive to a different range of current values.

In the present embodiment, the use of ferrite elements of a permeability of 2,500 to 4,000 will result in a sensor having a scale factor of around 40 mV/amp. In comparison, replacement of the ferrite elements by ceramic ones will result in a sensor having a scale factor of around a quarter of this value.

I claim:

1. A current transformer comprising:

(a) an elongated primary conductor means;

(b) a secondary conductor means comprising:

(1) a first coil on one side of said primary conductor means; and (2) a second coil on the other side of said primary conductor means, said first coil being connected to said second coil so as to ensure addition (within said first coil and said second coil) of emf induced by said primary conductor means and to facilitate common mode rejection of emf induced by external magnetic fields, said first coil and said second coil each having an opening formed therethrough; and (c) a magnetic coupling means comprising:

(1) a first ferromagnetic plate located above said primary conductor means and said secondary conductor means;

(2) a second ferromagnetic plate located below said primary conductor means and said secondary conductor means;

(3) a first ferrite element which extends from said first ferromagnetic plate to said second ferromagnetic plate through said opening in said first coil; and (4) a second ferrite element which extends from said second ferromagnetic plate to said second ferromagnetic plate through said opening in said second coil, whereby said first ferrite element, said first ferromagnetic plate, said second ferrite element, and said second ferromagnetic plate define a closed magnetic circuit, and said first ferrite element and said second ferrite element physically separate said first ferromagnetic plate from said second ferromagnetic plate.

2. The current transformer of claim 1, in which said first ferrite element and said second ferrite element have a permeability in the range 2,500 to 4,000.

3. The current transformer of claim 1, in which said first ferromagnetic plate and said second ferromagnetic plate is each made of mumetal.

4. The current transformer of claim 1, in which said first ferromagnetic plate and said second ferromagnetic plate are made of ferrite material.

5. The current transformer of claim 1 further comprising openings formed through said first ferrite element and said second ferrite element, whereby a pair of nuts and bolts assemble said ferrite elements to said ferromagnetic plates, with said bolts passing through said plates and said elements, such that said current transformer is easily disassembled to allow the removal and replacement of said ferrite elements.

6. The current transformer of claim 1 in which said primary conductor means comprises at least two parallel conductors.

* * * * *